United States Patent [19]

Makus et al.

[11] Patent Number: 4,731,267

[45] Date of Patent: Mar. 15, 1988

[54] ARTICLE AND METHOD FOR WOOD PRESERVATIVE TREATMENT

[76] Inventors: Sharon J. Makus; Warren L. Bennett, both of 11620 S.E. 45th Pl., Bellevue, Wash. 98006

[21] Appl. No.: 891,304

[22] Filed: Jul. 28, 1986

[51] Int. Cl.[4] ..... B27K 3/12; B27K 3/14

[52] U.S. Cl. ..... 428/35; 428/36; 156/185

[58] Field of Search ..... 428/35, 36; 156/185, 156/186; 52/720, 741; 405/231

[56] References Cited

U.S. PATENT DOCUMENTS

| | | | |
|---|---|---|---|
| 195,990 | 10/1877 | Culver | 156/185 |
| 3,467,490 | 9/1969 | Sommer | 156/185 |
| 4,174,412 | 11/1979 | Tyres et al. | 427/297 |

*Primary Examiner*—John E. Kittle
*Assistant Examiner*—James J. Seidleck
*Attorney, Agent, or Firm*—George M. Cole

[57] ABSTRACT

Wrap around article (10) for wood preservative treatment of wood poles, posts and the like, including an outside backing sheet (12) which has an inwardly and downwardly folded mounting flap (18) at the upper end thereof. A single or series of generally flat pockets or bags (30) on the inside of which is an absorbant pad (40). Wood preservative solution is added to the bag (30) and held in the pad (40) and the bag is sealed. The bags are attached to the flap (18). When the wrap around article (10) is to be applied, the inside faces of the bags are cut away exposing the pads soaked with the wood preservative. Upon installation the pads (40) contact substantially all of the circumference of the pole and the wood preservative penetrates the pole wood. In another form the pad material (40') is wrapped around the treatment zone, the pad saturated with wood preservative solution and then the backing (12') is secured over the pad.

3 Claims, 4 Drawing Figures

FIG. 3
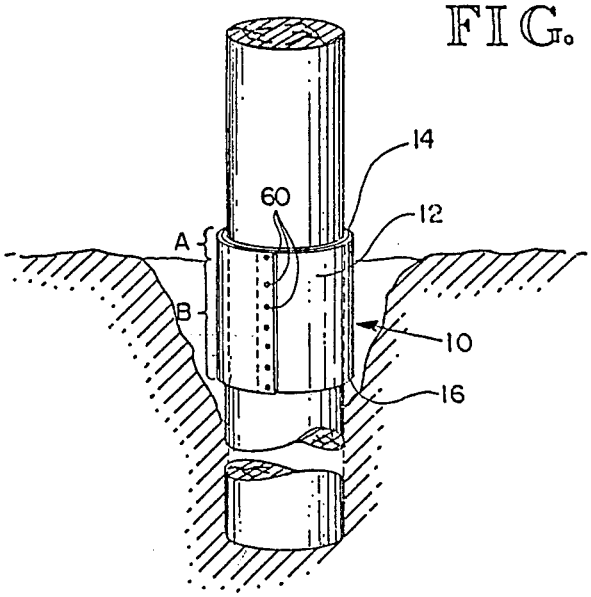
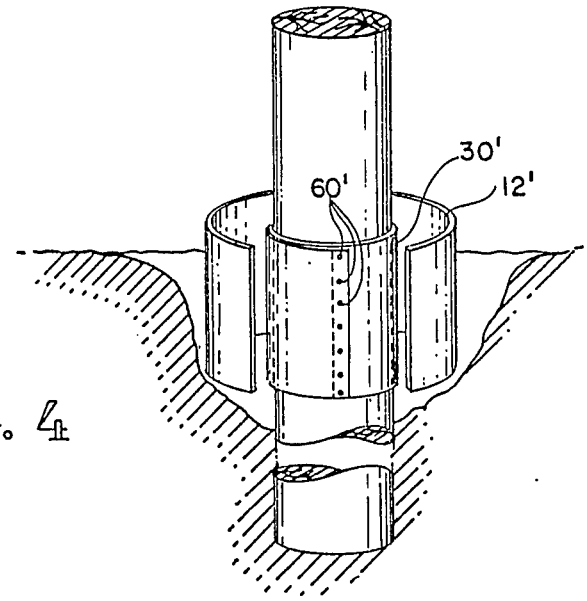
FIG. 4

ARTICLE AND METHOD FOR WOOD PRESERVATIVE TREATMENT

DESCRIPTION

1. Technical Field

This invention relates to the field of wood preservation and more particularly to the protection and preservation of wooden poles in the area in which they are most susceptible to decay which is at, below and slightly above groundline.

2. Background Art

It is variously estimated that in the United States alone there are 110 to 132 million wood poles in active use by utility companies and systems. Of these it is further estimated that there are 20 to 30 million standing poles in the field which need replacement now with another 4 to 6 million being added each year.

The problem, of course, is that wood rots. Untreated wood in the presence of adequate oxygen and moisture is attacked by fungi. There are other reasons for causing a pole to be classified as defective, however. Besides the various forms of mechanical damage, woodpeckers make hollows for nests, and carpenter ants, buprestid beetles and termites find poles desirable as living quarters and food.

Those skilled in the art such as owners of utility poles, posts, poles and railroad support pilings are well aware of the decay to which poles are subject. This is particularly true in the groundline zone to a depth of about eighteen inches below and above the groundline level. Owners are generally agreed that poles which are to be replaced, for instance, or reset may require special protection against decay if they have been in place 6 or more years.

As mentioned above, in the presence of oxygen, moisture and temperature wood is attacked by various fungi which feed on or dissolve the cellulose and lignins in the wood. Thus, food is provided for further fungi development and growth, and this is true whether the pole is being relocated or whether it remains in place.

Groundline wood preservative treatments are intended to enhance the original preservative treatment by impregnating the outer circumferential area or shell to a depth of up to 2 inches with a preservative which will deny a food source for the fungi. Because of the enormous number of poles in service, even small per-unit savings achieved by delaying or avoiding pole replacement can extrapolate to huge savings.

The American Wood Preservative Association (AWPA) sets standards for wood preservative solutions by specifying, for instance, that the copper naphthenate solution shall be prepared with a solvent conforming to AWPA Standard P9 and which solution shall contain a minimum of 2 percent copper metal. However, none of the known treatments can produce 100% penetration of the wood. Accordingly, once a pole is set it is most important to protect the outer shell of the pole up to 2 inches in depth from deterioration because the shell represents 90% of the pole's strength. Poles which upon inspection reveal decay in the outer shell at or below groundline can be treated with preservatives applied to the surface of the pole through the vital zone. The ideal preservative is one which will fortify or restore the original preservative treatment by penetrating up to 2 inches of the wood.

There are several commonly employed or typical treatments for achieving the desired results. One consists of a groundline paste compounded of wood preservative and petroleum creosote material which acts as a carrier for the wood preservative. Once the ground has been removed from contact with the pole or post down to a depth of 20 to 24 inches, the surface of the pole is brushed clean of decayed wood and dirt. The paste mixture is liberally applied to or smeared on the pole from the groundline down to about 20 inches and then a protective wrap of kraft or roofing paper is applied to protect the paste from being absorbed into the surrounding soil. In all instances, the products used consist of various types of sodium fluoride, pentachlorophenol, pentachlorophenates, coal tar creosotes or petroleum greases. Several companies in the industry use the system just described.

Another method of treating a pole at groundline involves the use of a bandage or wrapper which consists of a kraft paper backing on which is spread the wood preservative and creosote paste mixture. Over the paste mix is disposed a protective plastic film. The purpose of the kraft paper is to furnish a stiffening effect for easy handling and application of the wrap. The plastic film is removed before the wrap is applied to a pole. An alternative is a fiber sheet in roll form impregnated with the wood preservative. The exact size wrap needed for a given pole is cut off the roll and tacked to the crucial zone of the pole.

Under EPA regulations some wood preservatives such as pentachlorophenol are classified as carcinogenics and are therefore subject restrictions in their applications.

There are a number of disadvantages in the known and currently used art. For instance, the amount of wood preservative which is carried in the paste mixture is limited. The use of known carcinogenic chemicals like pentachlorophenol and creosote are a danger not only to the soil environment around the pole but are also dangerous to the individual applying the system. Pentachlorophenol especially migrates in all directions so it will penetrate the pole but will also be absorbed into the surrounding soil.

In the known groundline treatment systems the encapsulating or carrier agent represents about 70% of the total weight of the wrap. The carrier agent, however, performs only a nominal function once the wood preservative is released.

The only prior art reference of which applicants are aware is U.S. Pat. No. 3,467,490. This patent is an example of a system which uses an encapsulating agent and thus is not particularly pertinent to the details of the invention described and claimed herein.

DISCLOSURE OF THE INVENTION

The groundline treatment system of this invention comprises in one embodiment an article which is an absorbant pad applied and secured to the circumference of the vital groundline area where it is saturated with the wood preservative solution and then covered with a backing sheet which is also tacked or stapled in place over the pad.

In a second embodiment there is attached to the backing sheet a series, which may be single if desired or appropriate, of vapor impervious bags containing an absorbant pad. The bags and backing sheet are dimensioned so that the area to be treated is fully covered. The absorbant pad in each bag is provided with a wood preservative solution of copper naphthenate mixed with a light weight petroleum fuel such as diesel oil. The bags are sealed after filling. The copper naphthenate and fuel oil mixture is precisely metered into each bag so that when the wrap is to be applied there is substantially no drippage or release of the preservative. The bags are affixed to the backing sheet and a razor is used to quickly cut off the exposed surface of each bag of the article so the pad is exposed to the pole to allow direct contact between pad and wood.

Accordingly, it is among the many features of the invention to provide an article which is light and therefore easy to handle, which can be rapidly applied and which is simple, reliable and inexpensive. The wrap enables 70% of the total weight of a unit of wrap to be absorbed into the wood of the pole. The copper naphthenate is noncarcinogenic and therefore is free of restrictions imposed by government regulations on carcinogenics. Workers do not have excessive weight to deal with in the handling the wrap nor do they have messy and greasy paste material to contend with.

BRIEF DESCRIPTION OF THE DRAWINGS

FIG. 3 is a diagrammatic view showing an article secured in place on the groundline zone which is being treated on a pole; and FIG. 4 is a diagrammatic view showing a second embodiment in which the pad is applied directly to the pole and then soaked and covered.

BEST MODE FOR CARRYING OUT THE INVENTION

Figure 1:
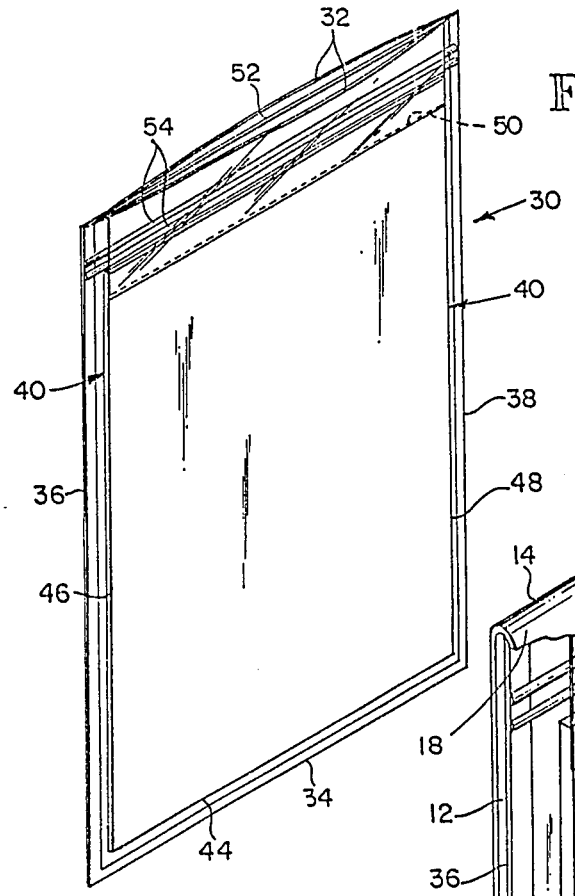
FIG. 1 is a perspective view of a vapor proof bag containing an absorbant pad and illustrates some details of the invention.
Figure 2:
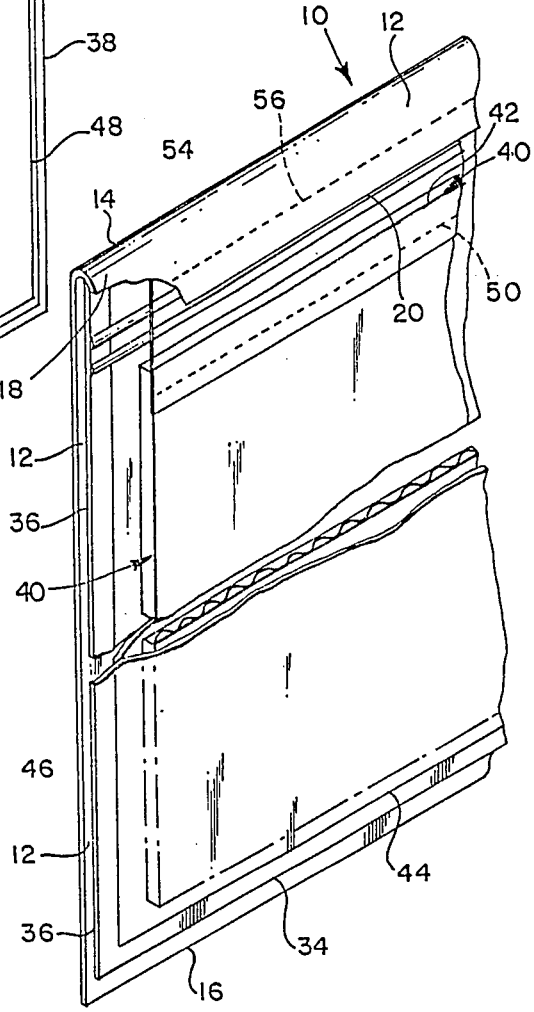
FIG. 2 is a perspective view the assembled pole article with the bag or bags mounted on the backing sheet.

Referring now to the drawings in FIGS. 1–3 it will be seen that the invention is generally referred to by the number 10.

A backing sheet 12 of dark plastic sheet about 4 mils thick and which is waterproof is preferred. The backing sheet 12 has upper or top edge 14 and bottom edge 16, the distance between which edges will vary from about 20 inches minimum to about 22½ inches maximum. The upper edge of the backing sheet will be provided with a bag mounting flap 18 which will lap over from top edge 14 to flap edge 20, a distance of approximately 1½ inches. The bottom edge 16 of backing sheet 12 will be spaced a predetermined distance below the lower end of the bag 30, which will be described more fully hereinafter. The backing is preferably a material that forms a good vapor barrier between pole and ground, will not crack at folds or creases, is puncture resistant to a degree, and resists decay and soil poisons. Additionally, it resists ultra violet rays, is a good heat transfer agent and is resistant to microbial growth such as mildew. An example of such a product is TU-TUF (Registered Trademark) a cross laminated poly sheeting produced by Sto-Cote Products, Inc.

The flat bag or bags, generally designated by the number 30, is a rectangular or square item of transparent, heat sealable plastic film. Bag 30 when sealed will be vapor proof and will have top edge 32, bottom edge 34, and side edges 36 and 38. Inside bag 30 will be inserted a rectangular or square absorbant pad 40 of from about 3/16 to about ⅜ inches thickness having top and bottom edges 42 and 44 respectively and side edges 46 and 48. Pad 40 has stitched, sewn or otherwise secured to the upper margin thereof, as at stitch line 50, a tab 52 also made of heat-sealable plastic film like bag 30. The tab 52 extends from the upper end of pad 40 to the upper edge 32 of the bag 30. Thus, it will be noted that the upper edge 42 of pad 40 is spaced downwardly from or below the upper edge 32 of bag 30. The bag is accurately filled with a mixture of wood preservative liquid made up of about 22% by weight of 8% copper naphthenate in mineral spirits together with about 78% by weight of AWPA P9 fluid such as diesel fuel and heat sealed. The final wood preservative liquid is approximately 2% by weight of copper naphthenate. It will be understood that up to 70% of the article weight is represented by the wood preservative solution. AWPA Standard M4-84 specifies that copper naphthenate solutions may be used for field treatment of material originally treated with pentachlorophenol, creosote, creosote solutions, or water borne preservatives. This preservative solution shall be prepared with a solvent conforming to AWPA Standard P9 and the preservative concentration shall contain a minimum of 2% copper metal as mentioned above. The quantity of solution dispersed into the bag and absorbed by the pad will amount to over six times the weight of the pad. After adding the preservative solution to the bag, the bag and tab 52 on the inside thereof are heat sealed together along spaced apart seal lines 54 above the pad. The pad is an oil absorbant which repels water, is a chemically inert synthetic fiber, does not disintegrate easily, has good anti-inflammability properties, resists extremes of heat, cold and humidity, is very light weight and gives up oil on contact with wood. An example is OIL SORBENT marketed by 3M.

The bags will be produced in several sizes, for instance in 12 or 18 widths and in lengths of 18 inches. It will be appreciated that the sizes may vary, but even with two sizes a choice of over all wrap lengths is available to suit the diameter of the pole being treated. Once filled and sealed, the bags are attached as by sewing, stapling or other means to mounting flap 18 as along line 56.

While the relatively thin pocket bags 30 have been described as made with a transparent, heat sealable plastic sheet, it will be appreciated that transparency is not mandatory. So long as the bags are vapor proof and can be sealed against leakage they will serve the purpose.

After a groundline excavation is prepared as illustrated in FIG. 3 down to a depth of 24 inches or so, the pole is brushed clean in the vital zone. Length of article 10 is selected to insure that the zone around the full circumference of the pole will be in contact with the pad. Before being applied, the entire inside facing of each bag in the wrap is cut away by razor or appropriate cutting tool so that all of the saturated pad inside each bag is exposed. The wrap is then mounted on the pole with the exposed pad or pads making physical contact with the wood. The article is pulled tight and secured to the wood by tacks or staples 60. the excavation may then be back filled. Placement of the wrap will extend an inch or so above grade. The wood immediately upon contact with the soaked pads begins to absorb the preservative. Penetration of the wood by the preservative will require a number of days, and such penetration will be well within the up to 2 inch depth desired.

FIG. 4 shows an alternative embodiment to the premade kit illustrated in FIGS. 1 to 3. In this embodiment the pad 30' is installed on the pole dry by drawing it tightly around the zone to be protected and securing it in place by tacks or staples 60'. Then the pad is sprayed to saturation with the wood preservative solution and backing sheet 12' is then wrapped around the pad and also securely fixed in place, also by tacking or stapling. In a matter of days the preservative solution will have been absorbed into the wood to provide protection for the wood against decay.

We claim:

1. A wrap around article for wood preservative treatment of wood poles, posts and the like, comprising:

(a) a backing sheet of sufficient length to extend around the circumference of a pole through a predetermined zone with some overlap thereof, said backing sheet being made of flexible plastic sheet which is also water proof and which of a predetermined length between its upper and lower ends, (b) generally rectangular pocket bag means secured to said backing sheet and which bag means extends around substantially all of the circumference of said pole, said bag means having on the inside thereof a substantially flat absorbant pad to a which a wood preservative solution is added so as to hold said wood preservative solution and wherein said bag means is also sealed so as to prevent leakage of said solution, and wherein before said wrap around article is applied to a pole substantially all of the exposed side of each said bag means is removed so that the absorbant pad means with said solution therein contacts said pole to permit the wood preservative solution to penetrate the wood.

2. The wrap around article according to claim 1 and wherein said wood preservative solution is copper naphthenate solution in diesel fuel oil carrier agent.

3. The wrap around article according to claim 1 and wherein said absorbant pad is from about 3/16 to about ⅜ inches in thickness.

* * * * *